US005092797A

United States Patent [19]

Cole et al.

[11] Patent Number: 5,092,797

[45] Date of Patent: Mar. 3, 1992

[54] ELECTRICAL WIRE CONNECTOR

[75] Inventors: Randy T. Cole, Thornhill; Barry J. Johnson, West Hill; Gino Menechella, Richmond Hill, all of Canada

[73] Assignee: AMP Incorporated, Harrisburg, Pa.

[21] Appl. No.: 727,027

[22] Filed: Jul. 8, 1991

[51] Int. Cl.[5] ..... H01R 11/01

[52] U.S. Cl. ..... 439/783; 411/2; 411/3; 411/5; 439/803

[58] Field of Search ..... 439/783, 790, 791, 794, 439/796, 803, 807; 411/1-3, 5, 7

[56] References Cited

U.S. PATENT DOCUMENTS

| | | | |
|---|---|---|---|
| 1,801,277 | 4/1931 | Kelley . | |
| 2,547,176 | 4/1951 | Salmons | 174/7 |
| 3,929,054 | 12/1975 | Gutshall | 411/5 |
| 4,027,939 | 6/1977 | White | 439/783 |
| 4,415,222 | 11/1983 | Polidori | 339/270 R |
| 4,600,264 | 7/1986 | Counsel | 439/783 |
| 4,730,087 | 3/1988 | Werner | 439/783 |
| 4,857,020 | 8/1989 | Crosby | 439/783 |
| 4,863,403 | 9/1989 | Shannon | 439/783 |
| 4,915,653 | 4/1990 | Maier | 439/783 |

FOREIGN PATENT DOCUMENTS

| | | | |
|---|---|---|---|
| 0946189 | 4/1974 | Canada | 411/2 |
| 2352400 | 6/1974 | Fed. Rep. of Germany | 411/2 |
| 0898026 | 6/1962 | United Kingdom | 411/3 |

OTHER PUBLICATIONS 2 photos of a product sold by Connector Products Inc. of Pennsauken, NJ.

*Primary Examiner*—Paula A. Bradley
*Attorney, Agent, or Firm*—Anton P. Ness

[57] ABSTRACT

An electrical wire connector (10) has a C-shaped body section having arcuate ears (22) laterally therealong and converging from a wide end to a narrow end and forming wire grooves (24), a wedge having converging concave side surfaces (32) forming wire channels opposing wire grooves (24) when inserted into the wide end of the C-shaped member (12), and a shear head drive bolt (50) for urging the wedge (14) into the C-shaped member upon actuation to compress and thus interconnect respective wires (16,18) placed along the wire channels. The drive bolt (50) has an outer hexagonal head (54) joined to a smaller inner hexagonal head (56) at a frangible section to be sheared off upon achievement of a selected torque level which assures interconnection of the wires when attained. The facets of the inner head are angularly offset out of phase with the outer head facets (64) so that corners (66) of the smaller inner head (56) axially align with centers of the outer head facets (64) and are radially aligned with facets (64) or are incrementally radially inwardly thereof, so that a socket of a wrench placed over the bolt (50) for actuation can only be axially misaligned an incremental angle minimizing shear due to bending moment rather than full torque.

6 Claims, 5 Drawing Sheets

ELECTRICAL WIRE CONNECTOR

FIELD OF THE INVENTION

This relates to the field of electrical connectors and more particularly to connectors for interconnecting a pair of uninsulated wire conductors for grounding.

BACKGROUND OF THE INVENTION

Wire connectors are known which interconnect a pair of uninsulated wire conductors for grounding of electrically powered apparatus. A conductive insert is wedged into a C-shaped member, compressing the wires between ear sections of the C-shaped member and opposing concave surfaces of the sides of the wedge. One such connector utilizes a drive bolt which is rotated by a socket wrench for example to incrementally drive a wedge having converging sides into a C-shaped member also having converging ears until compression of the wires increases the torque necessary to rotate the drive bolt to such a level that the tool-engaged outer bolt head shears from the bolt at a frangible section, indicating that sufficient compression has been attained in the interconnection and leaving a second, inner bolt head accessible if disassembly is later required. An example of such a connector is disclosed in U. S. Pat. No. 4,600,264. One such product is sold by AMP of Canada, Ltd., Markham, Ontario, Canada under the trademark AMP WRENCH-LOK Connector.

It is desirable to provide a shear head drive bolt which assures that shearing results from achievement of the desired torque, and not from a bending moment inadvertently applied to the outer bolt head by the socket wrench during application.

SUMMARY OF THE INVENTION

The present invention is an improved shear head bolt wherein the inner bolt head is reduced in cross-sectional size from the outer bolt head, enabling the socket of the wrench to engage the outer bolt head for rotation with only minimal engagement with the inner bolt head. The invention also provides that the conventional hexagonal shape of the inner bolt head is angularly offset from the hexagonal shape of the outer bolt head to be precisely out of phase, so that corners of the hexagon of the inner bolt head are aligned with the centers of the faces of the hexagon of the outer bolt head. Further, the size of the inner bolt head is selected to be large enough that the corners extend radially outwardly only as far as the centers of the faces of the outer bolt head, or incrementally less, so that when the socket of appropriate size is disposed over both the outer and inner heads the inside work surfaces of the socket are opposed from the outer head faces for engagement and rotation, but are opposed from the corners of the inner bolt head. If the socket were perfectly axially aligned with the drive bolt during rotation, engagement would occur with the outer head faces but no engagement would occur with the inner head. During normal operation however, a socket commonly tends to tilt to an angle from true axial alignment, applying a bending moment to the outer head of a conventional double head shear bolt. In the present invention, the inner bolt head corners are engaged by the socket's inner surfaces almost immediately to prevent more than a minimal angle from being attained, thus tending to keep the socket substantially axially aligned without interfering with applying torque to only the outer head. Thus the socket wrench will have only minimal tendencies to shear off the outer bolt head from a bending moment and at a torque level less than desired.

An embodiment of the present invention will now be described by way of example with reference to the accompanying drawings.

DESCRIPTION OF THE PREFERRED EMBODIMENT

Figure 1:
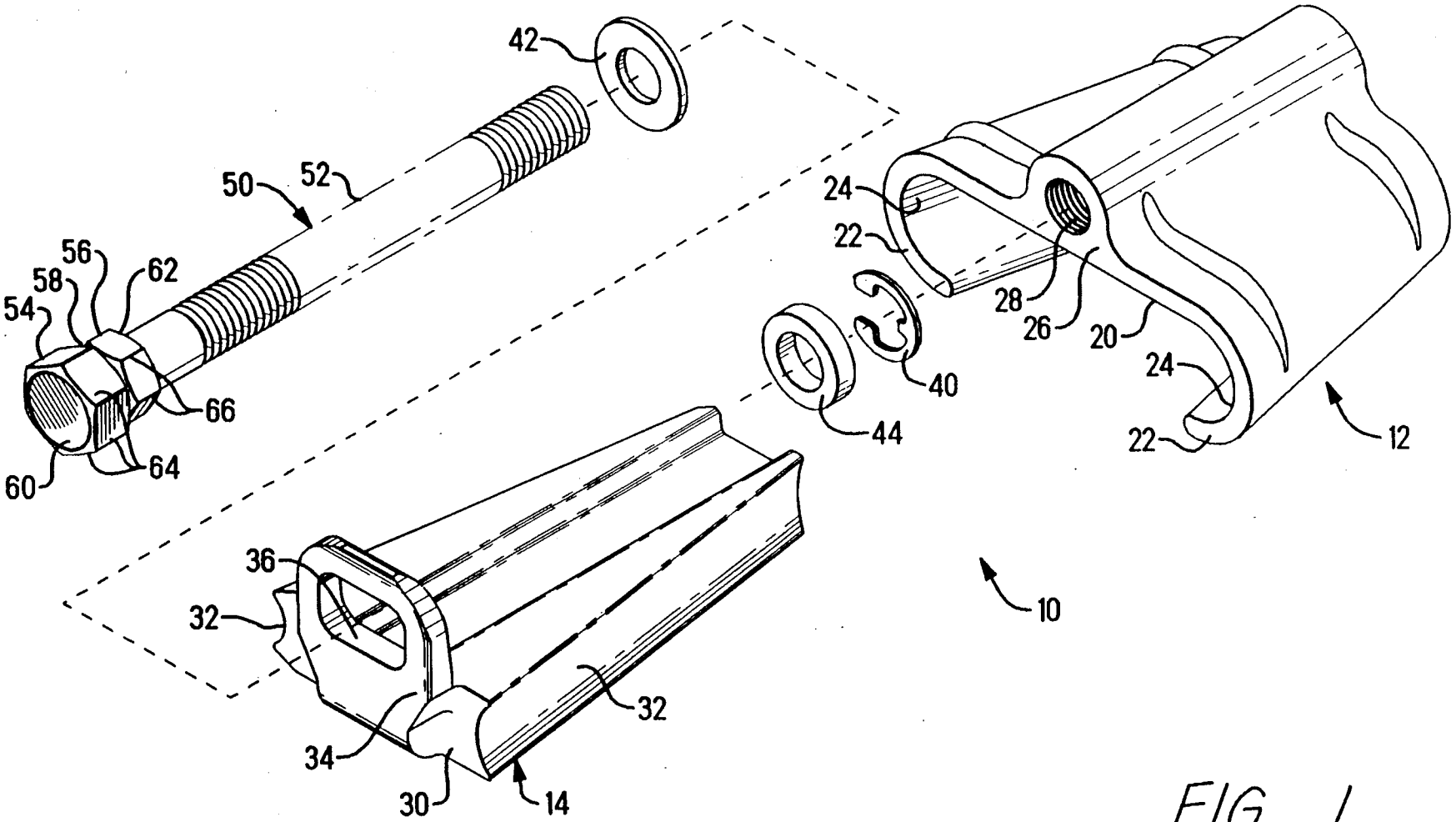
FIG. 1 is an isometric exploded view of the connector containing the present invention.
Figure 2:
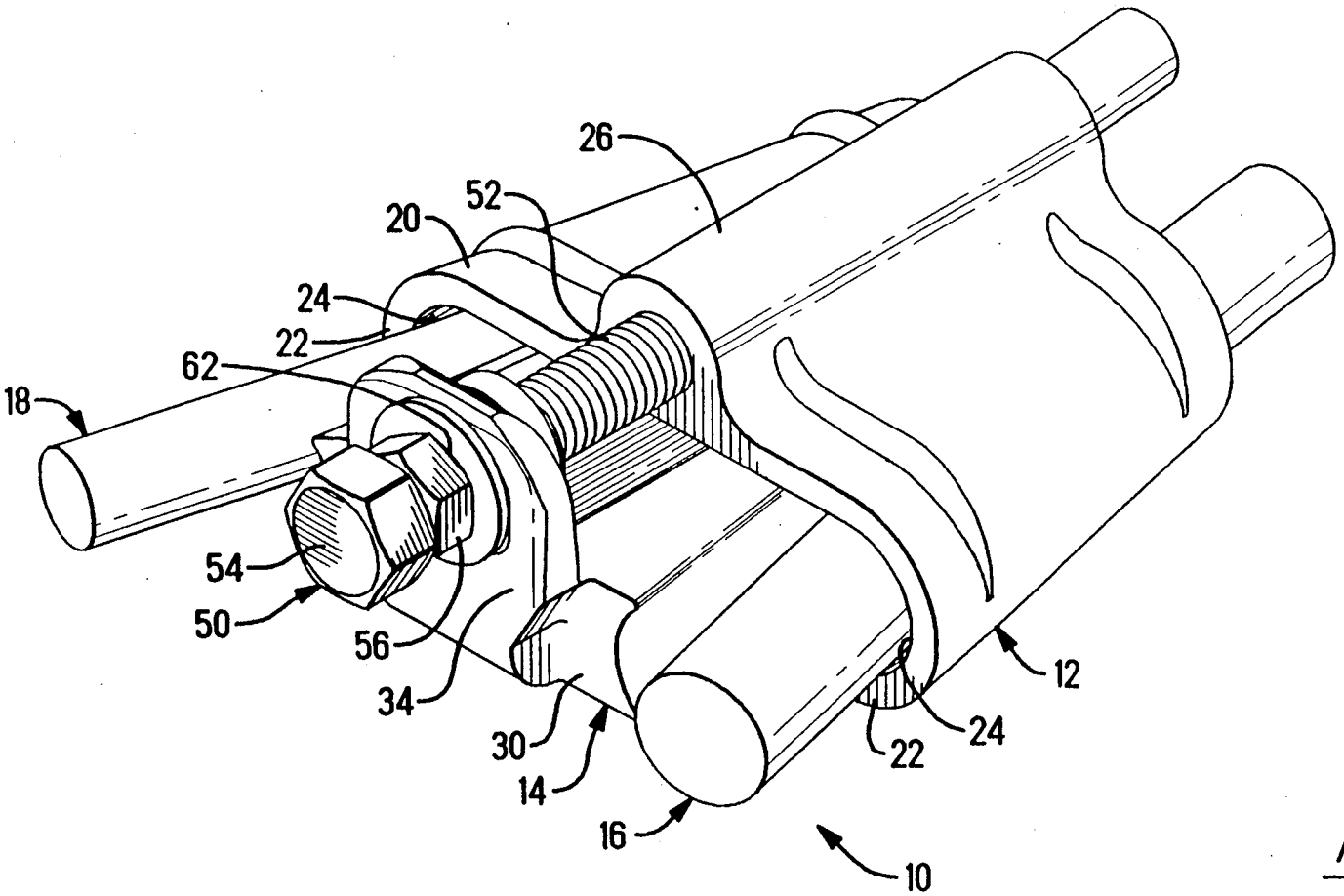
FIGS. 2 and 3 are isometric views of the connector of FIG. 1 prior to and after application to a pair of wires, respectively, with the outer bolt head sheared off in FIG. 3.
Figure 3:
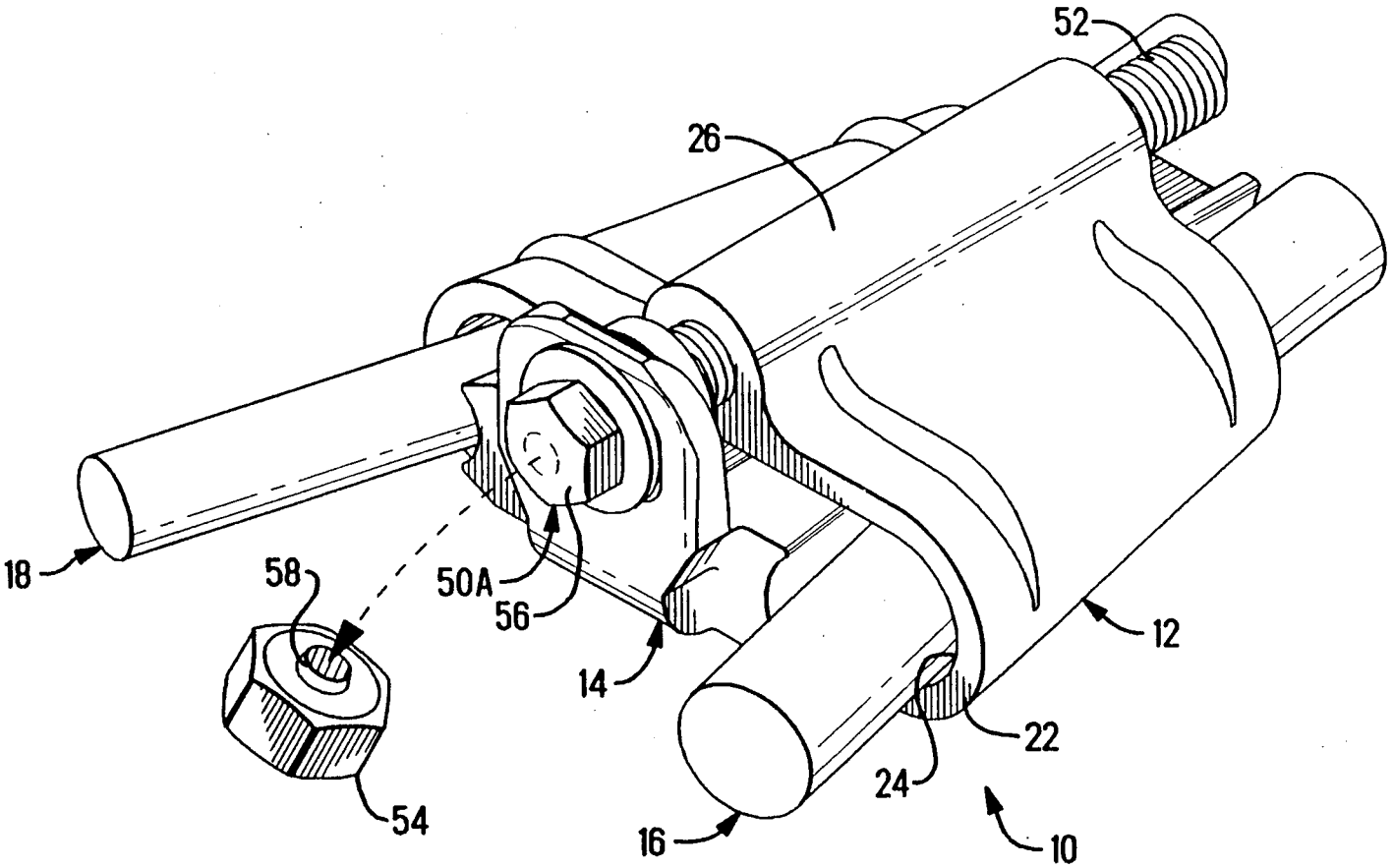

Connector 10 in FIGS. 1 to 3 comprises a C-shaped body member 12, wedge 14 and drive bolt 50 to be applied to uninsulated wires 16,18 to interconnect them under substantial compression. C-shaped body 12 includes a transverse section 20 extending laterally to opposed arcuate ears 22 defining wire grooves 24 which converge from one end toward the other along transverse section 20. Axial flange embossment 26 is disposed centrally of transverse section 20 and includes partially threaded aperture 28 extending the length of C-shaped body 12 into which drive bolt 50 will be threaded during application.

Wedge 14 comprises preferably a solid body 30 shaped and dimensioned to be received into C-shaped body from the relatively open end thereof, and includes converging concave side surfaces 32 therealong which cooperate with opposing wire grooves 24 of C-shaped body 12 to define wire channels to contain wires 16,18 therein. Transverse flange 34 extends outwardly from wedge body 30 at the wide end and includes a slot 36 therethrough through which shank 52 of drive bolt 50 will be inserted prior to being threaded into aperture 28 of C-shaped body 12; slot 36 permits the orientation of wedge 14 to become adjusted during application to wires 16,18 since drive bolt 50 is constrained to remain perfectly aligned within threaded aperture 28 of C-shaped body 12.

Drive bolt 50 includes an elongate threaded shank 52, an outer head 54, an inner head 56 and a frangible section 58 between outer and inner heads 54,56. Outer head 54 has an outer shank-remote surface 60, and inner head 56 has an inner shank-proximate surface 62. Outer head 54 and inner head 56 both preferably have hexagonal cross-sections enabling use of conventional socket wrenches for rotation of bolt 50. Drive bolt 50 is assembled using a retention clip 40 to clip onto shank 52 after insertion through slot 36 of transverse flange 34 of wedge 14; a stainless steel belleville washer 42 is used between inner surface 62 of inner head 56 and transverse flange 34 of wedge 14, and a plastic washer 44 may be used between transverse flange 34 and retention clip 40.

Figure 4:
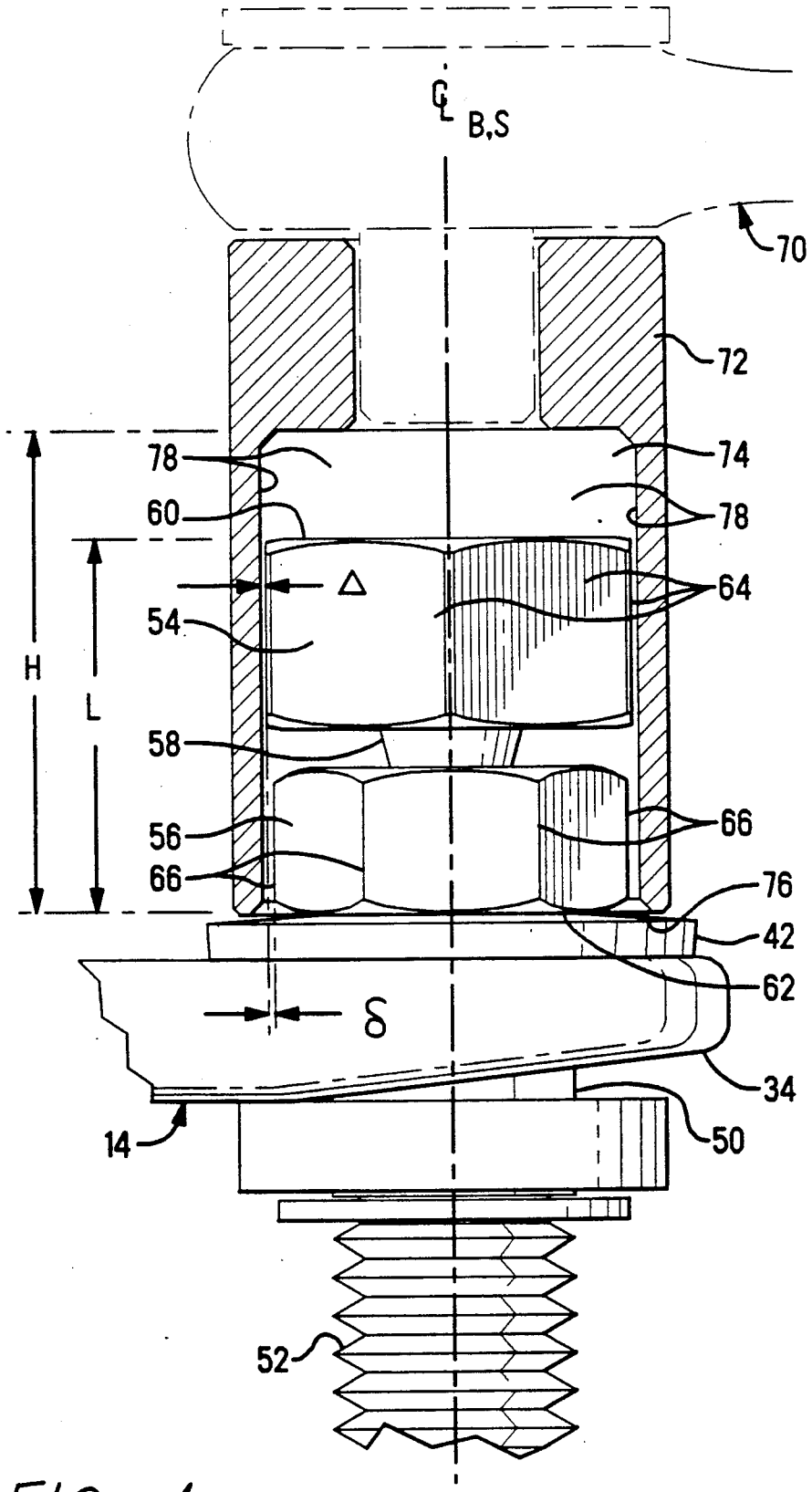
FIGS. 4 and 5 are enlarged longitudinal section views of the work end of the bolt having the socket of a wrench applied thereover, with FIG. 4 demonstrating true axial alignment and FIG. 5 demonstrating the limit of misalignment permitted by the present invention.
Figure 5:
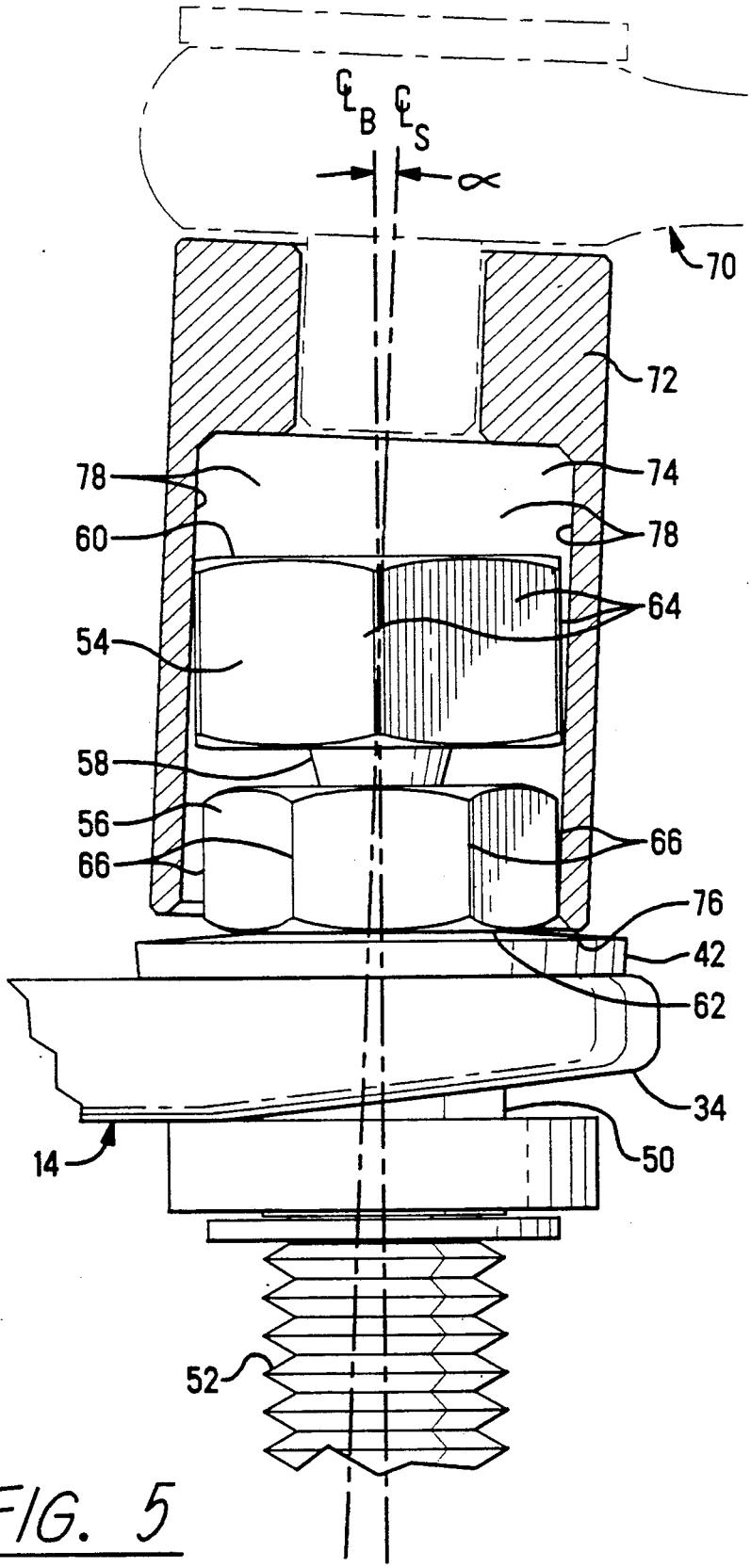

Referring to FIG. 2 and to FIGS. 4 and 5, both inner and outer heads 56,54 are exposed outwardly from transverse flange 34 of wedge 14 to receive thereover socket 72 of a wrench 70 to be disposed within cavity 74 thereof. Washer 42 and transverse flange 34 provide forward limits to the leading end 76 of socket 72 as is conventional. Washer 42 also would provide a surface for abutment of the leading end 76 of the socket which tends to maintain generally the alignment of the socket about outer and inner bolt heads 54,56 were inner head 56 simply smaller than outer head 54 as in some prior art double head shear bolts. Otherwise severe tilting of the socket would occur since the inner head would not provide a second or stabilizing engagement with the work surfaces inside the socket to maintain alignment, in cooperation with the outer head engagement at a first engagement axially spaced therefrom. In one type of bolt, an integral flange is formed on the bolt itself between the outer and inner heads to assist in maintaining socket alignment, but the outer head is only received into the leading portion of the socket cavity instead of deeply thereinto, which has been found to make application of torque more difficult and technique sensitive.

The desire to provide deeper fitting of a socket over a shear-head drive bolt has led to the desire to reduce the size of the inner head and removal of any flange or lock washer from between the outer and inner heads, as was used for limiting sockets with prior art bolts, in order to allow torque to be applied only to the outer head in order for it to be sheared with respect to the inner head. A socket having a depth of three-quarter inch is preferable, shown as in FIG. 4. However, a moment or bending force would now be possible during routine ratchet-type socket wrench use were simply a smaller inner head to be used, since the leading socket end would not continuously remain in abutment with washer 42 during bolt rotation.

FIGS. 4 and 5 demonstrate that the present invention uses a smaller inner head but offsets the arrangement of the hexagon of the cross-sectional shape of the outer head 54 with respect to that of the inner head 56 preferably precisely out of phase angularly, or by about 30°. Thus corners 66 between the faces of inner head 56 are aligned with the centers of faces 64 of outer head 54. Also the dimensions of inner head 56 are selected so that corners 66 extend radially outwardly a distance equal to or just less than the radial distance of the centers of faces 64 of outer head 54. In FIG. 4 inside surface facets 78 of a socket 72 selected to be the appropriate size for rotating outer head 54 and oriented appropriately angularly, fit adjacent faces 64 of outer head 54, and are shown slightly incrementally spaced from corners 66 of inner head 56 as is preferred. Socket 72 is shown in FIG. 4 to be precisely axially aligned because leading end 76 thereof abuts washer 42, and is of an appropriate size for use with bolt 50 being only incrementally larger than outer head 54. Socket centerline $CL_S$ is coincident with bolt centerline $CL_B$.

During routine use of socket wrench 70, however, socket 72 is likely to become axially misaligned when left unconstrained, simply due to manipulation of wrench 70, thus tending to apply a bending moment to outer head 54. In the present invention, corners 66 of inner head 56 become engaged with facets 78 of socket 72 after only a minimal angle $\propto$ of axial misalignment of socket 72 with drive bolt 50. The resultant angle of maximum tilt $\propto$ is defined between socket centerline $CL_S$ and bolt centerline $CL_B$, which is determined by engagement of a socket work surface or facet engaged at the rear edge of a face 64 along outer surface 60, and a socket work surface engaged at the forwardmost point of a corner 66 opposite from face 64 along inner surface 62, of a socket of appropriate dimension for applying torque to outer head 54. It is believed that some deformation of corner 66 could occur in practice due to the force levels typically attained which would result in only a negligible increase in the actual angle achieved. The precise optimum incremental difference in diagonal distances between faces 64 and between corners 66 depends on the distance between outer surface 60 and inner surface 62, which also bears on actual angle defined by a misaligned socket. The angle $\propto$ would have practically its only contribution being the dimension $\Delta$ by which the socket diameter exceeds the outer bolt head dimension, and practically no contribution results from a difference in size of the inner head relative to that of the outer head.

In the preferred embodiment for one particular bolt size, the outer head face-to-face distance may be about 0.74 inches, and the inner head corner-to-corner distance may be about from 0.70 to 0.72 inches; the length L of the bolt from outer surface 60 and inner surface 62 would be about from 0.67 to 0.77 inches, averaging 0.715 inches given manufacturing tolerances. Thus with the difference $\delta$ in the diagonal dimension of the outer head face-to-face and the inner head corner-to-corner being 0.00 to about 0.04 inches or even up to about 0.08 inches in conjunction with an axial distance between socket engagement points of about 0.715 inches, there is only negligible contribution to the angle of maximum potential axial misalignment of the socket during use. For shear bolts of other sizes the relationship of the outer head face-to-face diagonal and the inner head corner-to-corner diagonal can be a difference calculated in percent form as about 0.0% to about 1.1% and preferably about 0.4% of the outer surface to inner surface axial length.

The present invention thus allows outer head 54 to become sheared from drive bolt 50 at frangible section 58 (FIG. 3) when the selected maximum torque has been achieved assuring that an appropriate gas-tight interconnection has occurred between wires 16,18 and wedge 14 and C-shaped member 12 of the connector. Absence of outer head 54 is a visual indication of full and assured interconnection; inner head 56 is now exposed for application of an appropriately smaller socket of a wrench for rotating during connector removal. Engagement of socket facets 78 with corners 66 results in no tendency to continue applying torque to inner head 56 while applying torque to outer head 54.

C-shaped body member 12 and wedge 14 may be made for example by being drawn or cast aluminum, with commercially available inhibitor material such as full synthetic resin having embedded metal particles at least coating the wire-engaging surfaces to minimize corrosion especially if a copper wire is to be interconnected. Shear-head drive bolt 50 may be made from aluminum such as Alloy 2024 which is first extruded, then cold-rolled to define the threads and impacted for head formation and having the retention clip slot machined thereinto; frangible section 58 preferably consists of a reduced diameter neck section machined between the inner and outer heads to meet torque requirements for the outer head 54 to shear within the range of 170 inch pounds to 200 inch pounds of torque preferably. Drive bolt 50 preferably is coated along its shank with an anti-seize and lubrication compound conventionally used on aluminum to prevent galling and binding, such as NEVER SEEZ extreme pressure lubricant (trademark of Bostic Company, Chicago, Ill.).

The embodiment described and shown is one example of the present invention, and the invention is capable of being modified and varied without departing from the spirit of the invention or the scope of the claims.

What is claimed is:

1. An improved electrical wire connector of the type having a C-shaped body member having laterally therealong opposing arcuate ears converging from a wide end to a narrow end and receiving into said wide end a wedge member having opposed converging side surfaces concave therealong defining wire-receiving channels in cooperation with corresponding ones of said arcuate ears opposed therefrom, all for receipt thereinto of respective uninsulated wire conductors therealong to be interconnected upon compression between said wedge member and said C-shaped member by actuation of a drive bolt causing said wedge member to be driven into the wide end of said C-shaped body and held therein, where said drive bolt is of the type having a threaded shank threadedly engagable with said C-shaped body member and an inner head having a shank proximate surface engagable with said wedge for urging said wedge toward said C-shaped member upon actuation, and having an outer head adapted to be rotated by a tool to break from said inner head upon a selected torque being achieved and extending axially outwardly to a shank-remote outer surface from a frangible joint with said inner head, said inner and outer heads having cross-sectional shapes comprising facets forming a selected regular polygon having sides having centers at selected respective radial distances from the centerline of the shank whereby the bolt is adapted to be engaged by a work end of a tool comprising a socket having a complementary polygonal cross-section and an appropriate dimension for rotation of the bolt, the improvement comprising:

said inner head having outwardly facing facets intersecting at corners angularly aligned with centers of outwardly facing facets of said outer head; and said inner head having a smaller cross-sectional dimension such that a diagonal between opposing ones of said corners is no greater than a diagonal between opposing ones of said facets of said outer head, minimizing the angle of maximum misalignment of said socket with respect to said bolt when said socket is placed thereover for rotation of said drive bolt.

2. The improved electrical wire connector of claim 1 wherein the relationship of a difference between said outer head face-to-face diagonal and said inner head corner-to-corner diagonal can be between 0.0% and 1.1% of a distance axially between said outer surface and said inner surface.

3. The improved electrical wire connector of claim 2 wherein said difference is about 0.4% of said distance axially between said outer surface and said inner surface.

4. An improved drive bolt of the type having a threaded shank, an inner head having a shank-proximate inner surface, and an outer head extending axially outwardly to a shank-remote outer surface from a frangible joint with said inner head, said inner and outer heads having cross-sectional shapes comprising facets forming a selected regular polygon having sides having centers at selected respective radial distances from the centerline of the shank whereby the bolt is adapted to be engaged by a work end of a tool comprising a socket having a complementary polygonal cross-section and an appropriate dimension for rotation of the bolt, the improvement comprising:

said inner head having outwardly facing facets intersecting at corners angularly aligned with centers of outwardly facing facets of said outer head; and said inner head having a smaller cross-sectional dimension such that a diagonal between opposing ones of said corners is no greater than a diagonal between opposing ones of said facets of said outer head, minimizing the angle of maximum misalignment of said socket with respect to said bolt when said socket is placed thereover for rotation of said drive bolt.

5. The improved drive bolt of claim 4 wherein the relationship of a difference between said outer head face-to-face diagonal and said inner head corner-to-corner diagonal can be between 0.0% and 1.1% of a distance axially between said outer surface and said inner surface.

6. The improved drive bolt of claim 4 wherein said difference is about 0.4% of said distance axially between said outer surface and said inner surface.

* * * * *